US005343927A

United States Patent [19]

Ivansson

[11] Patent Number: 5,343,927

[45] Date of Patent: Sep. 6, 1994

[54] METHOD AND A DEVICE FOR PRESS CASTING

[75] Inventor: Hans Ivansson, Herrljunga, Sweden

[73] Assignee: Tour & Andersson AB, Sweden

[21] Appl. No.: 30,224

[22] PCT Filed: Oct. 3, 1991

[86] PCT No.: PCT/SE91/00661

§ 371 Date: Mar. 23, 1993

§ 102(e) Date: Mar. 23, 1993

[87] PCT Pub. No.: WO92/05900

PCT Pub. Date: Apr. 16, 1992

[30] Foreign Application Priority Data

Oct. 5, 1990 [SE] Sweden ..... 9003193-1

[51] Int. Cl.[5] ..... B22D 17/12; B22D 17/20; B22D 27/09

[52] U.S. Cl. ..... 164/120; 164/113; 164/313; 164/342

[58] Field of Search ..... 164/113, 120, 284, 313, 164/319, 320, 342

[56] References Cited

U.S. PATENT DOCUMENTS

| | | | |
|---|---|---|---|
| 2,804,666 | 9/1957 | Sanes | 164/313 |
| 3,038,220 | 6/1962 | Saives . | |
| 3,443,628 | 5/1969 | Carr . | |
| 3,534,802 | 10/1970 | Carr . | |
| 4,436,140 | 3/1984 | Ebisawa et al. . | |
| 4,505,318 | 3/1985 | Tokui et al. | 164/113 |
| 4,519,436 | 5/1985 | Ebisawa et al. | 164/113 X |
| 4,601,321 | 7/1986 | Tokui et al. . | |
| 5,143,141 | 9/1992 | Frulla | 164/120 |

FOREIGN PATENT DOCUMENTS

| | | | |
|---|---|---|---|
| 0361837 | 4/1990 | European Pat. Off. . | |
| 55-016772 | 2/1980 | Japan . | |
| 56-6769 | 1/1981 | Japan | 164/313 |
| 56-163070 | 12/1981 | Japan | 164/313 |
| 61-27161 | 2/1986 | Japan | 164/120 |
| 89/12518 | 12/1989 | World Int. Prop. O. . | |

OTHER PUBLICATIONS

Abstract of Japanese Patent Publication 56-36369 Published Apr. 9, 1981.

Abstract of Japanese Patent Publication 59-130668 Published Jul. 27, 1984.

*Primary Examiner*—J. Reed Batten, Jr.

*Attorney, Agent, or Firm*—Davis, Bujold & Streck

[57] ABSTRACT

A liquid metal (49) poured into a filling chamber (20) is influenced in this chamber by a lower piston (43) and an upper piston (18), which are mounted on a lower machine table (5) and an upper machine table (10) respectively, which tables (5 and 10 respectively) support a lower mold part (24) and an upper mold part (22) respectively. The filling chamber (20) is disposed in or at the lower mold part (24) and receives, as regards the poured-in amount of metal, the lower piston (43), which is adjustable as to its elevational level and can be adjusted to make the amount of metal reach a level somewhat below the mold cavity (51) between the mold parts (22, 24). The lower piston (43) has a larger diameter than the upper piston (18), which, in connection with the filling of the metal (41), is designed to be lowered to a central position in a guiding and feeding sleeve (19) in the upper mold part (22) and is retained in this position by an adjustable holding force. The lower piston (43) is subsequently designed to be pressed upwards and carry out the basic feeding into the mold cavity (51), counteracted up to the holding force by the upper piston (18), which is designed to, in the final phase of the basic feeding, be actuated by a larger force and be lifted somewhat to an upper holding position. The upper piston (18) is designed to, subsequent to the pressing movement of the lower piston (43), be activated and lowered to a lower position, the final pressing being done, subsequent to which the mold parts (22, 24) are designed to be opened up and to release the casting.

9 Claims, 14 Drawing Sheets

Figure 1:
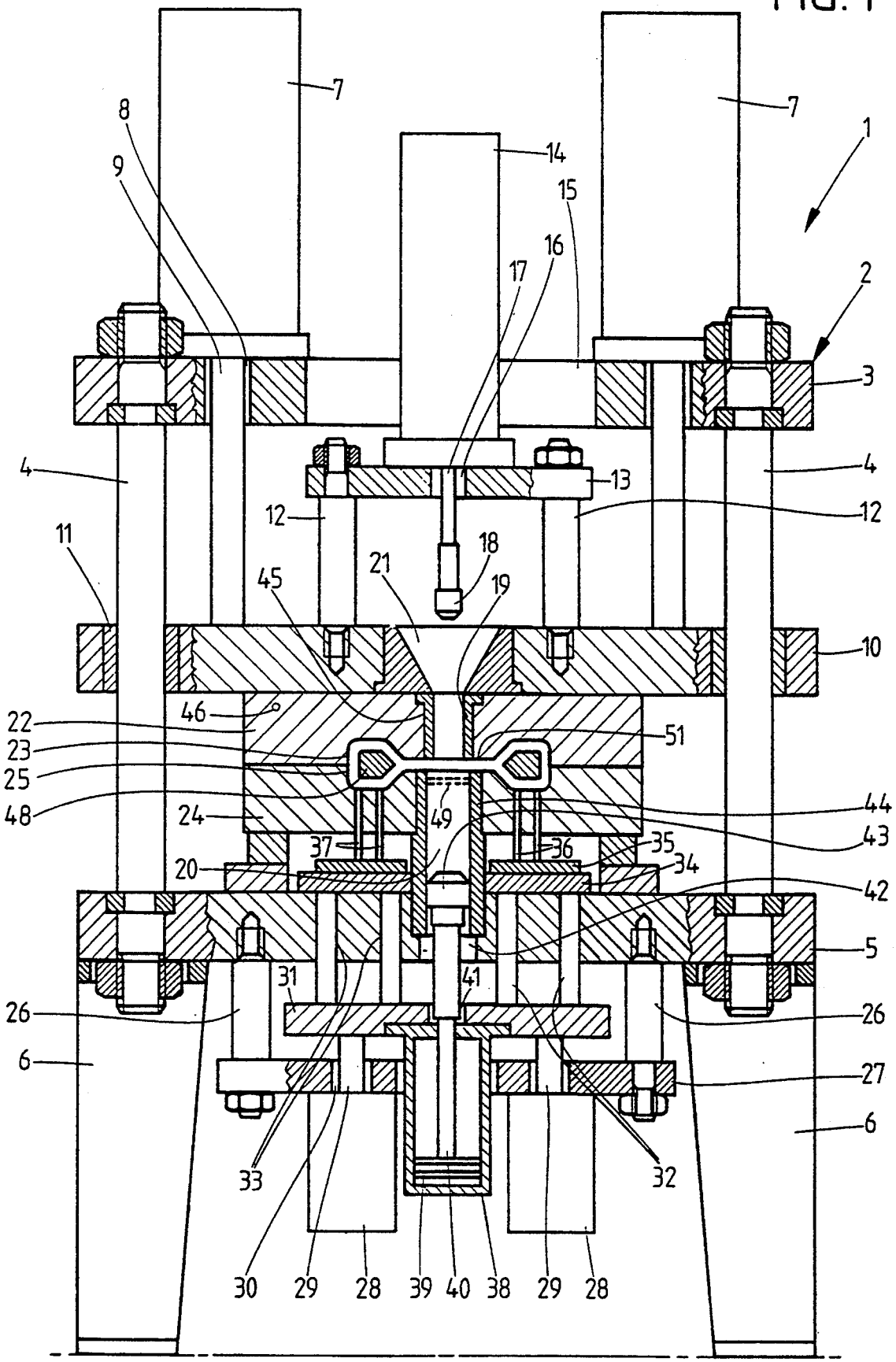

1
2
3
4
5
6
7
8
9
10
11
12
13
14
15
16
17
18
19
21
22
23
24
25
26
27
28
29
30
31
32
33
34
35
36
37
38
39
40
41
42
43
44
45
46
48
50
51

1
2
3
4
5
6
7
8
9
10
11
12
13
14
15
16
17
18
19
21
22
23
24
25
26
27
28
29
30
31
32
33
34
35
36
37
38
39
40
41
42
43
44
45
46
48
51

METHOD AND A DEVICE FOR PRESS CASTING

The present invention relates to a method of press casting. The invention also relates to a device, designed for press casting.

In order to in a rational way utilize the capacity of a press casting machine it is in most cases used to cast different objects. In order to cast these different objects, i.e. to change from a casting of a certain type of object to a certain other type of object, the lower piston as well as the upper piston are usually exchanged as well as the sleeve which constitutes the filling chamber and of course the mold as well as the sleeve, which surrounds the lower piston. These measures are of course always time-consuming and expensive processes and therefore objectionable. Also, the casting process is made more difficult in this way, since e.g. constantly changed diameters of casting pistons, used a little while, lead to varying pressures, which in practice is not acceptable on indeed not feasible. Consequently, a change as regards the casting piston diameter, i.e. an exchange of a casting piston, must be accompanied by a corresponding change of the compression pressure of the machine. This implies automatically a substantial risk of having the personnel make miscalculations or wrong adjustments of the pressure, resulting in a worse quality or actually a rejection of castings.

Particularly when the casting is done under relatively low pressures, e.g. between 1 and 200 bars, a few problems, so far unsolved, will appear. The rationale of such a low pressure casting is to make possible a use of sand mold cores, which in its turn makes possible a production of more complicated products or products, which are to meet high quality requirements, e.g. car rims, sand mold cores however not being absolutely required. The particular complex of problems of a low pressure casting comprises partly the necessity of continuously using strongly heated molds and a superheated metal and partly prolonged cycle periods, since the solidification times are absurdly prolonged, e.g. between 100 and 300 seconds. Thanks to the comparatively slow solidification the metal structure will be coarse and have a low strength. In case a blacking occurs, it is true that it is advantageous during the filling of the liquid metal, but it is a drawback during the ensuing solidification, because it prolongs the cycle periods and contributes to a larger grain size and hence a coarser structure and a lower strength. Thus, it has so far been necessary in many cases to oversize the products.

JP 59-130688 relates to already known techniques in this field. The lower piston according to this specification has a larger diameter than the upper piston, but no specific reasons or explanations are mentioned why this is or must be the case. The activation of the initiation of the movement of the upper piston is done, when a pressure influence has been obtained from the melt via the movement upwards of the lower piston. As regards the lower piston only a general movement upwards is mentioned. As regards the upper piston only a general movement downwards is mentioned.

The object of the present invention is to, in the above-mentioned respects, improve and develop the already known method and devices of press casting. Also, another object is to, in this field, develop the state of the art in various respects and create opportunities of a rationally useful technique and products having a high and uniform quality.

One particular object of the present invention is to improve the casting when relatively low pressures are used by achieving shorter cycle periods, improved product quality, particularly as regards a higher strength, a lower porosity and a finer material structure, namely a material structure having finer grains. Blacking normally is to be avoided and a surface with finer grains obtained, if possible.

It is particularly advantageous according to the invention, if the lower piston is moved upwards to a mechanical stop element in its upmost position, the upper end surface of the lower piston, when necessary, forming the lower surface of the object or objects to be molded. Also, the upper piston must be able to be moved upwards with a small counter pressure, in case the space in the mold and between the pistons is completely utilized and consequently allow the lower piston to reach its uppermost position. Also, the actuation of the upper piston is to be completely programmable, as regards time as well as speed.

Figure 2:
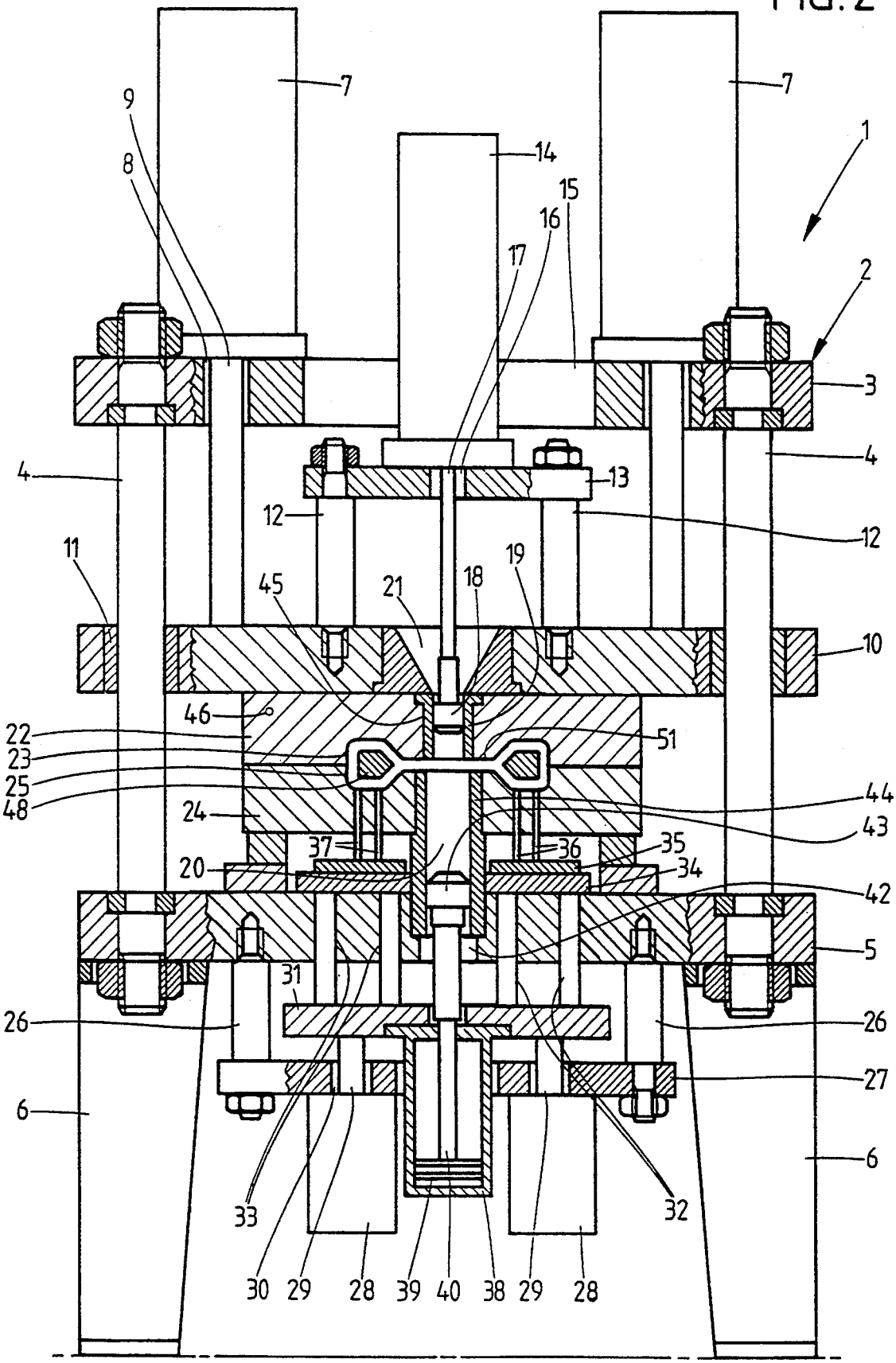
Figure 3:
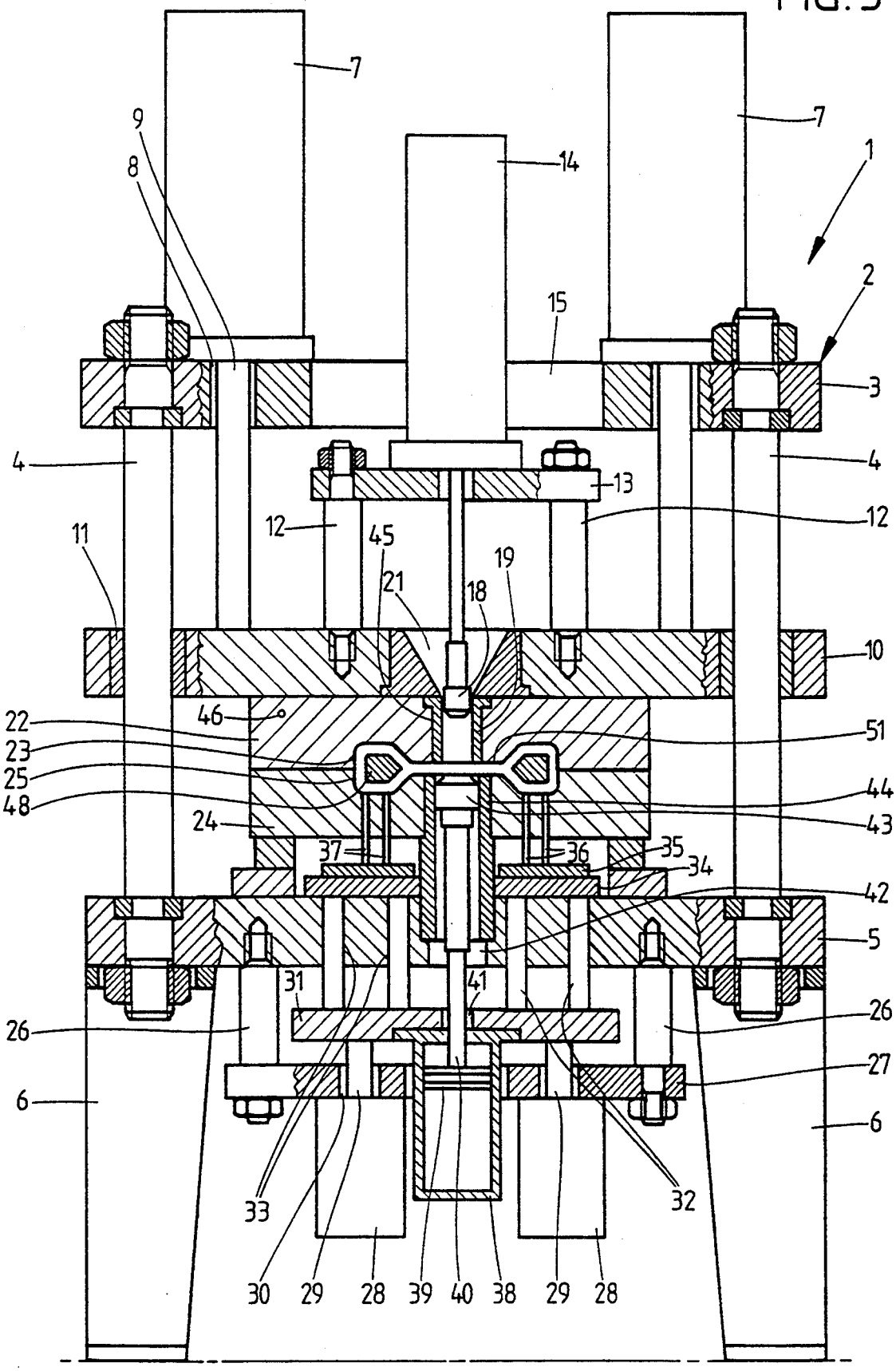
Figure 4:
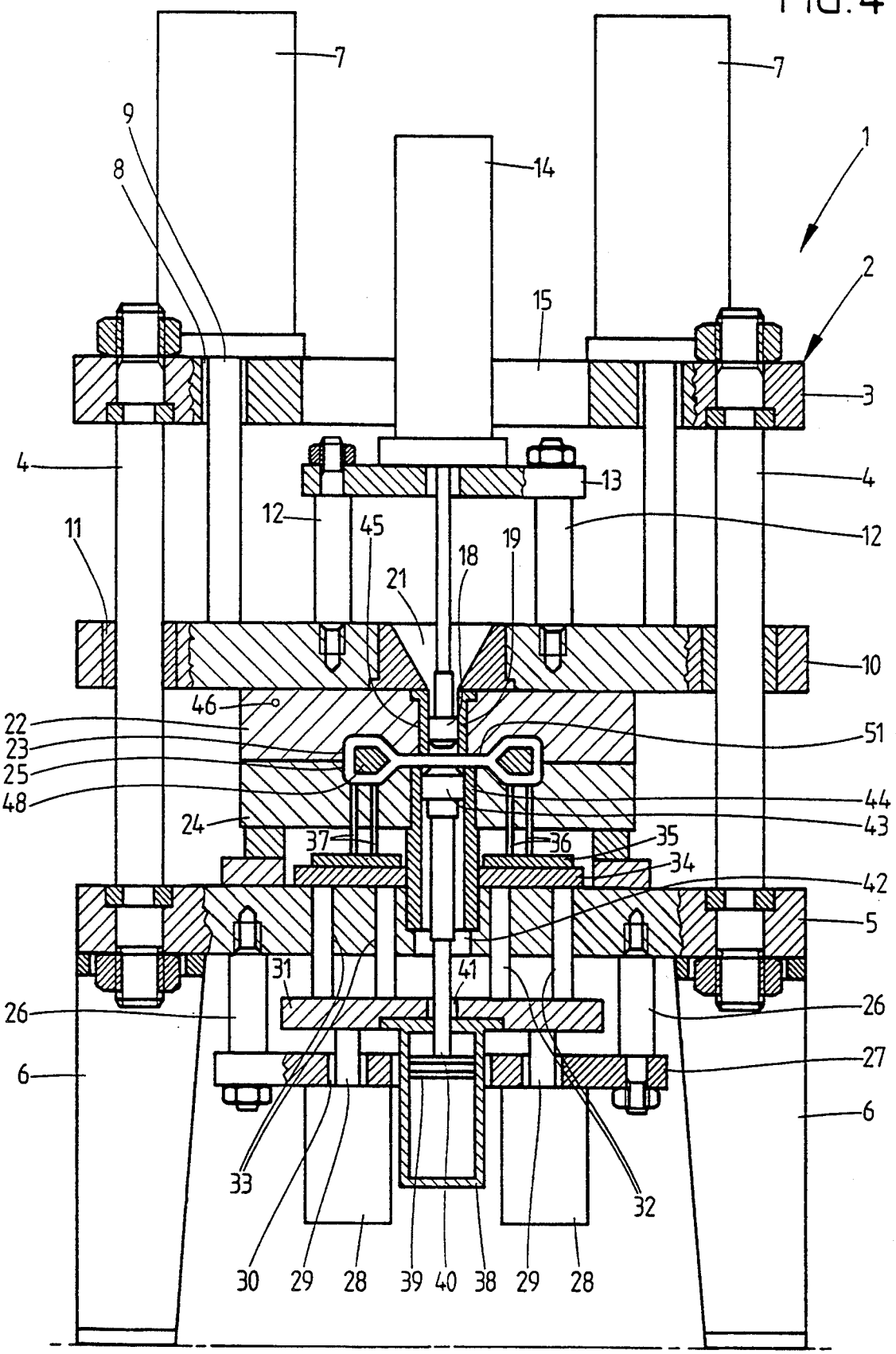
Figure 5:
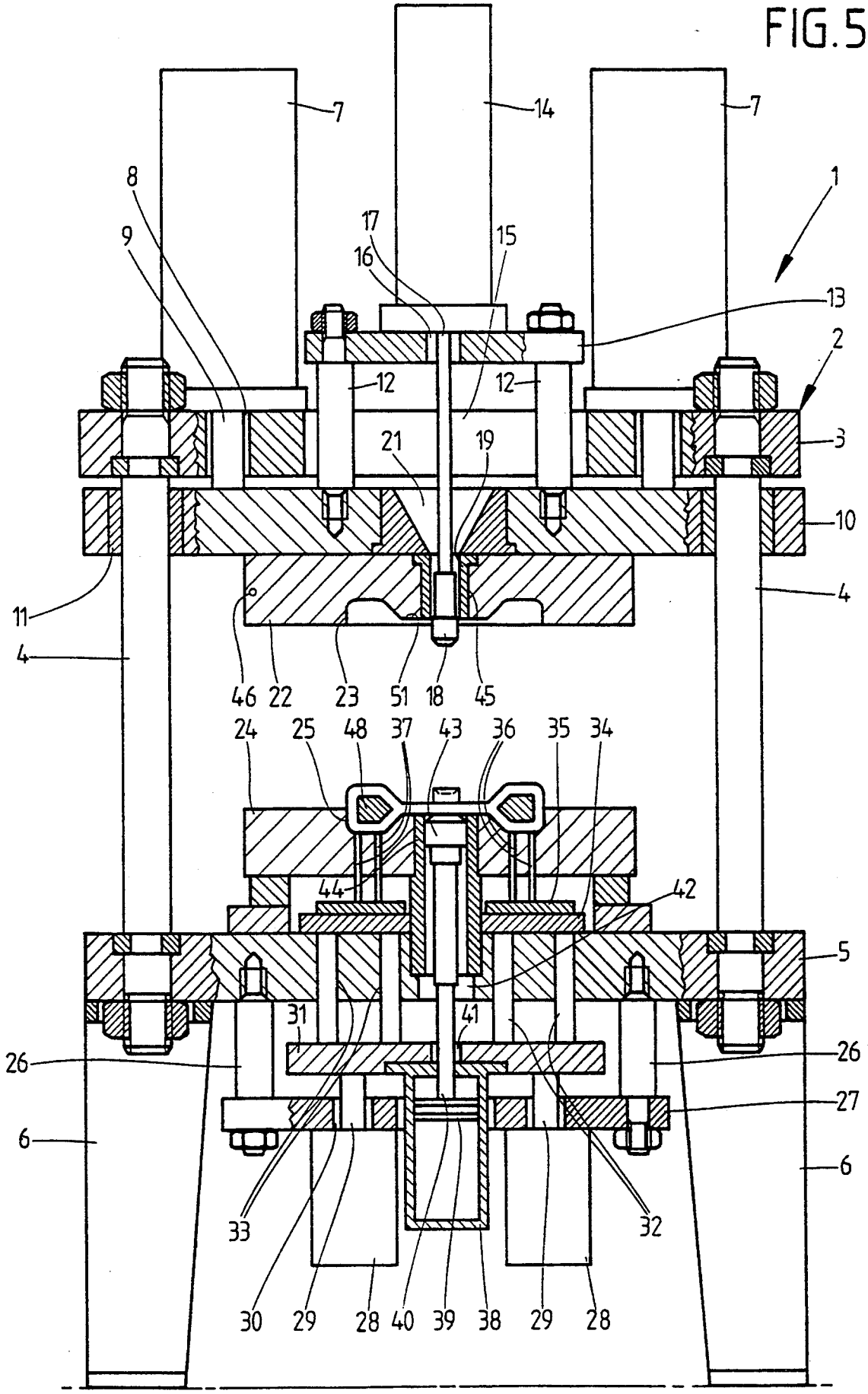
Figure 6:
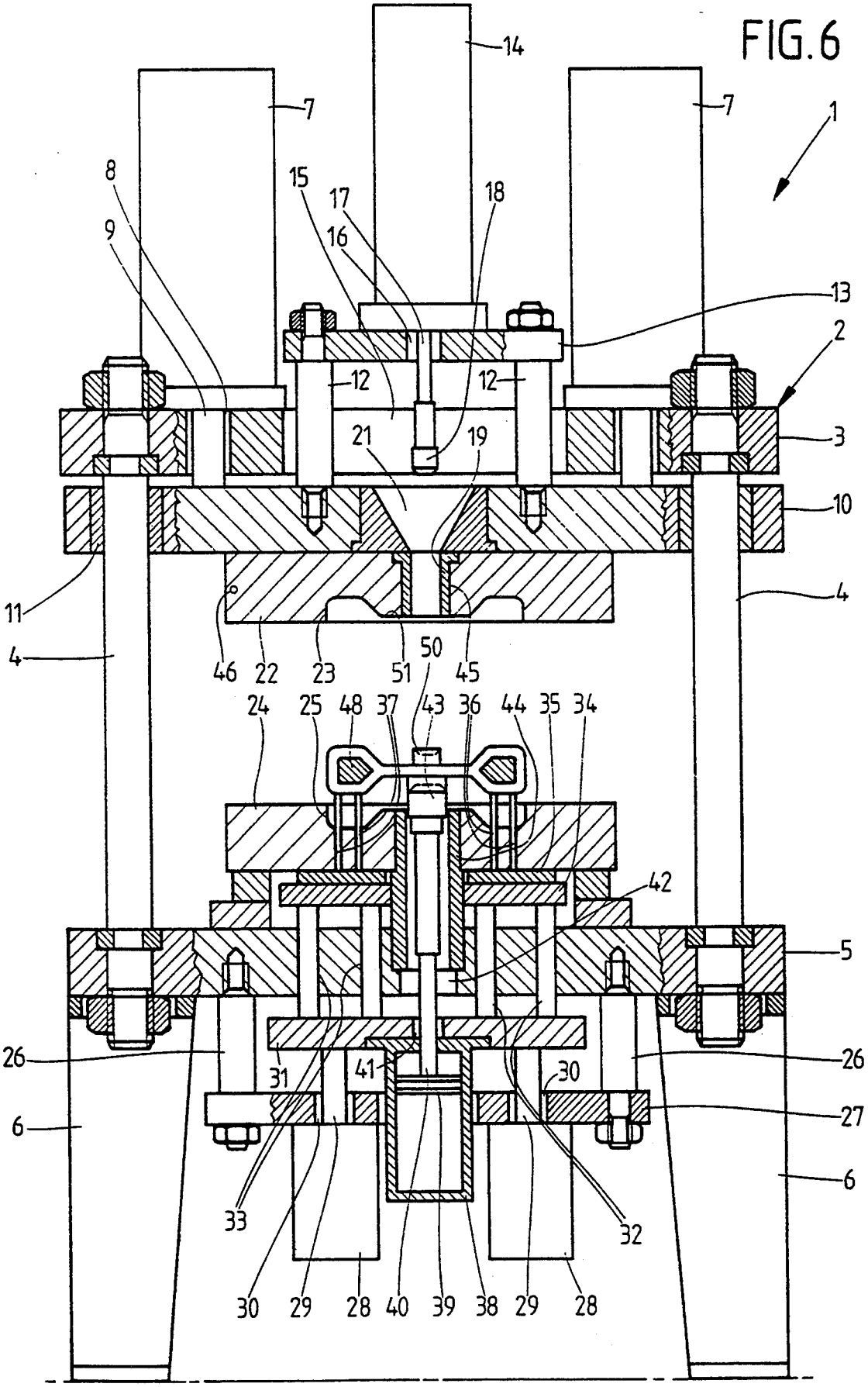
Figure 7:
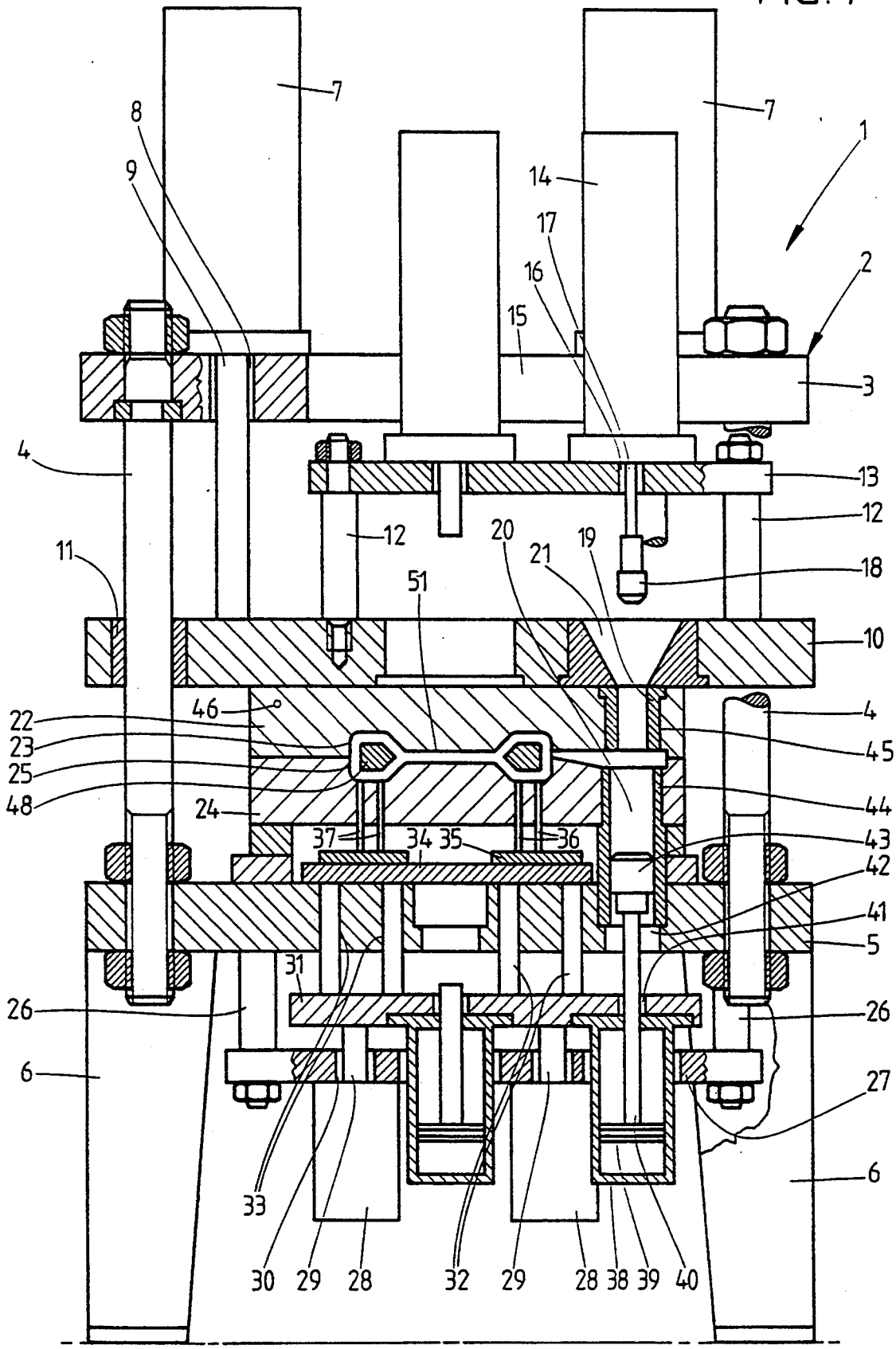
Figure 8:
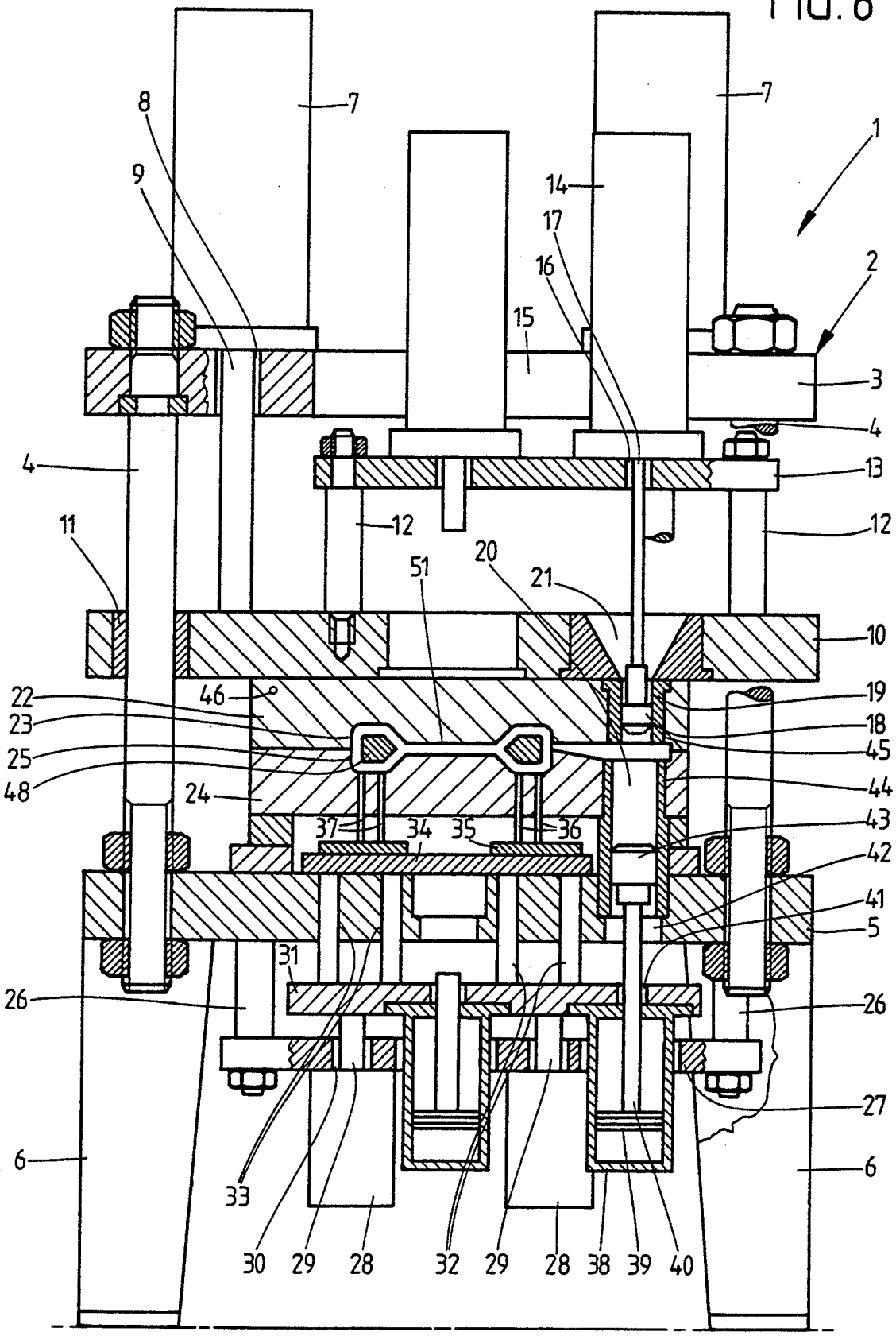
Figure 9:
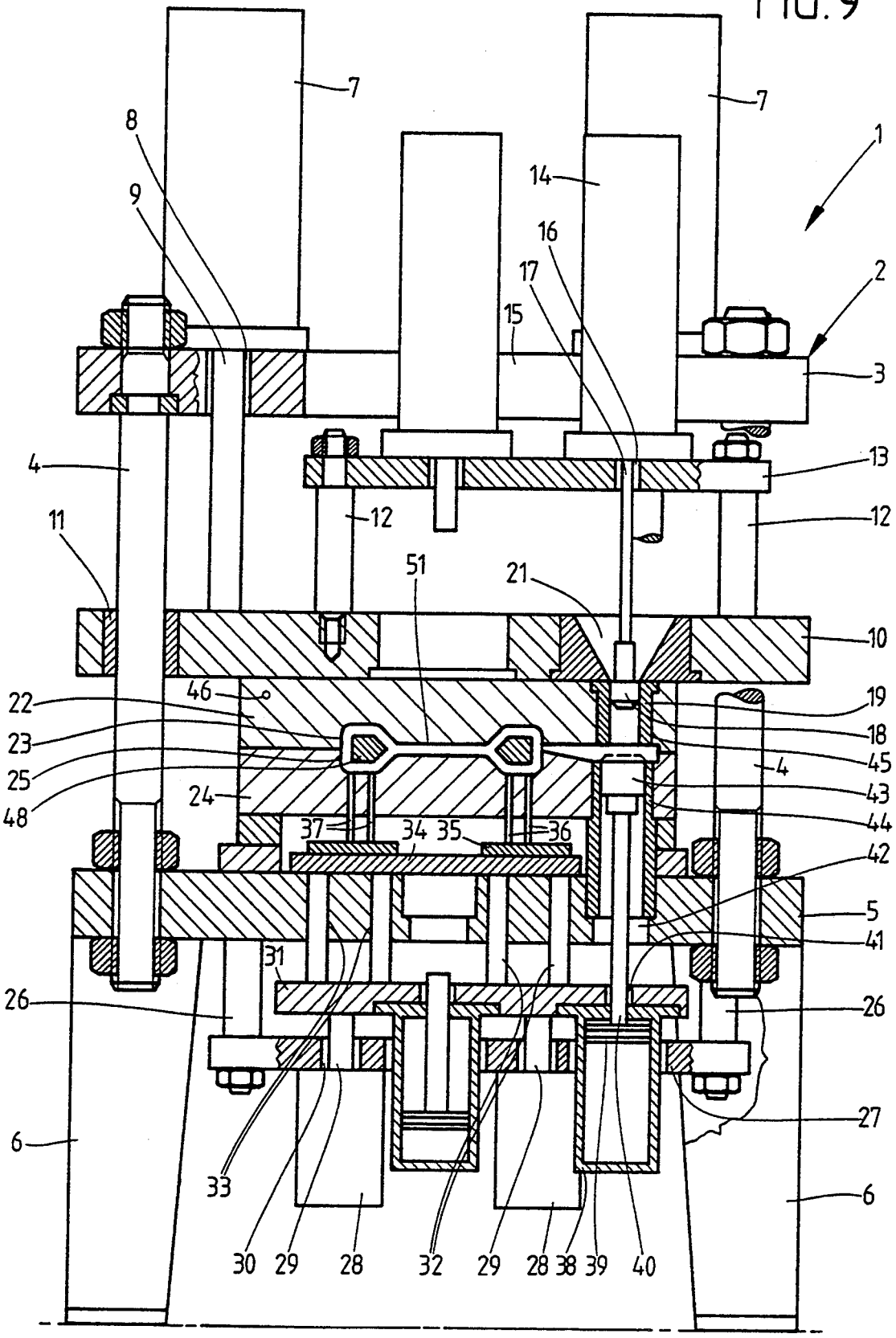
Figure 10:
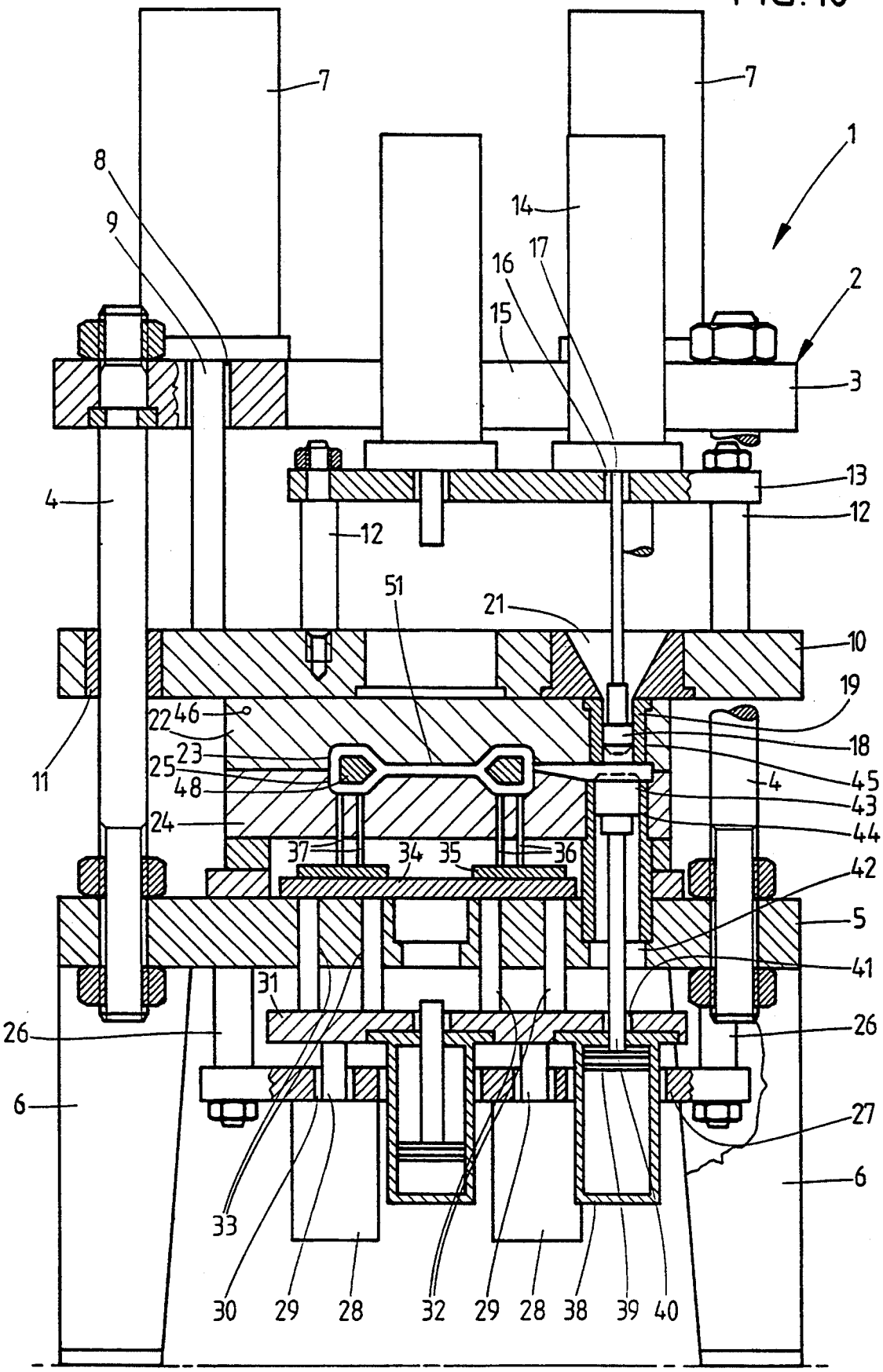
Figure 11:
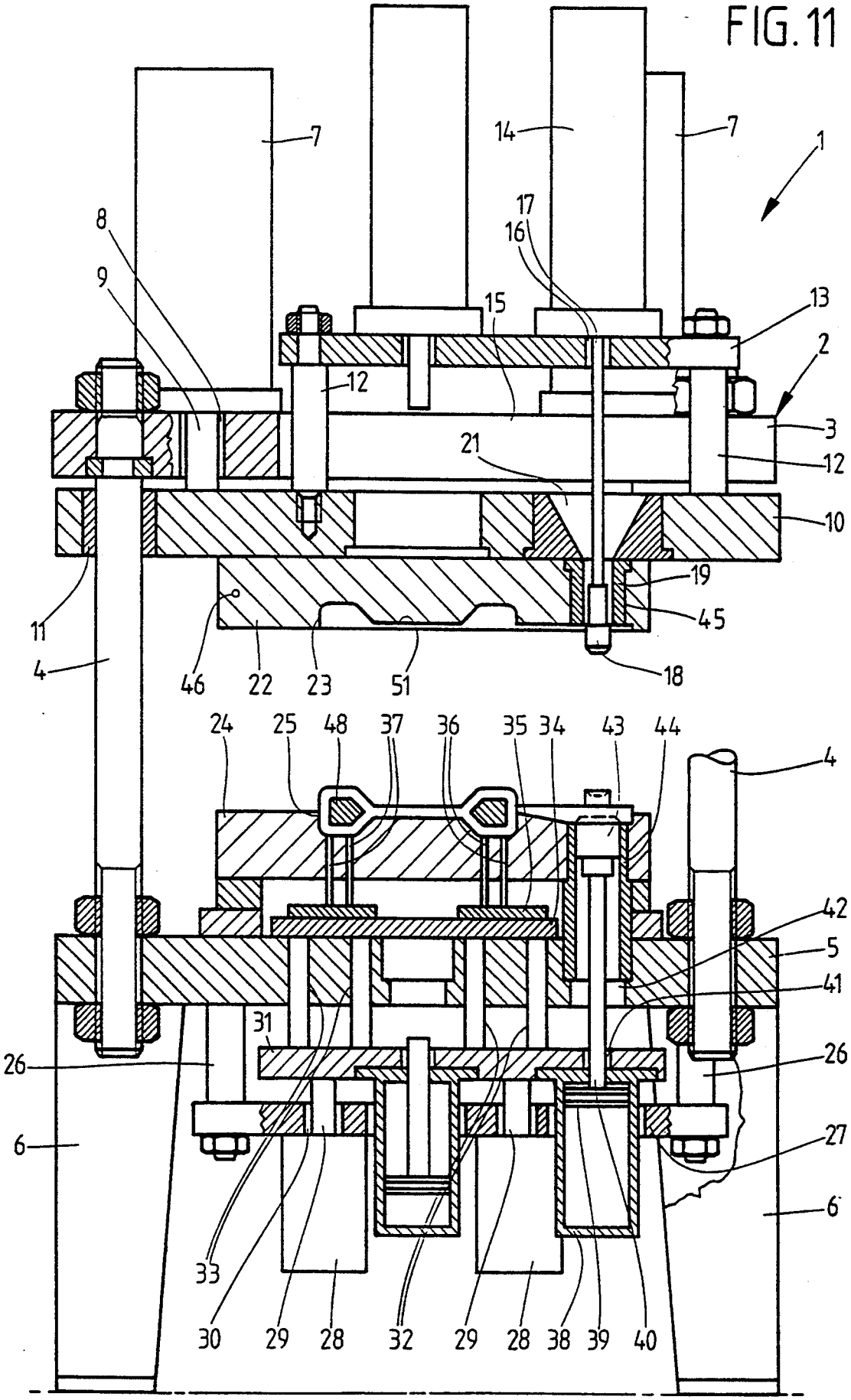
Figure 12:
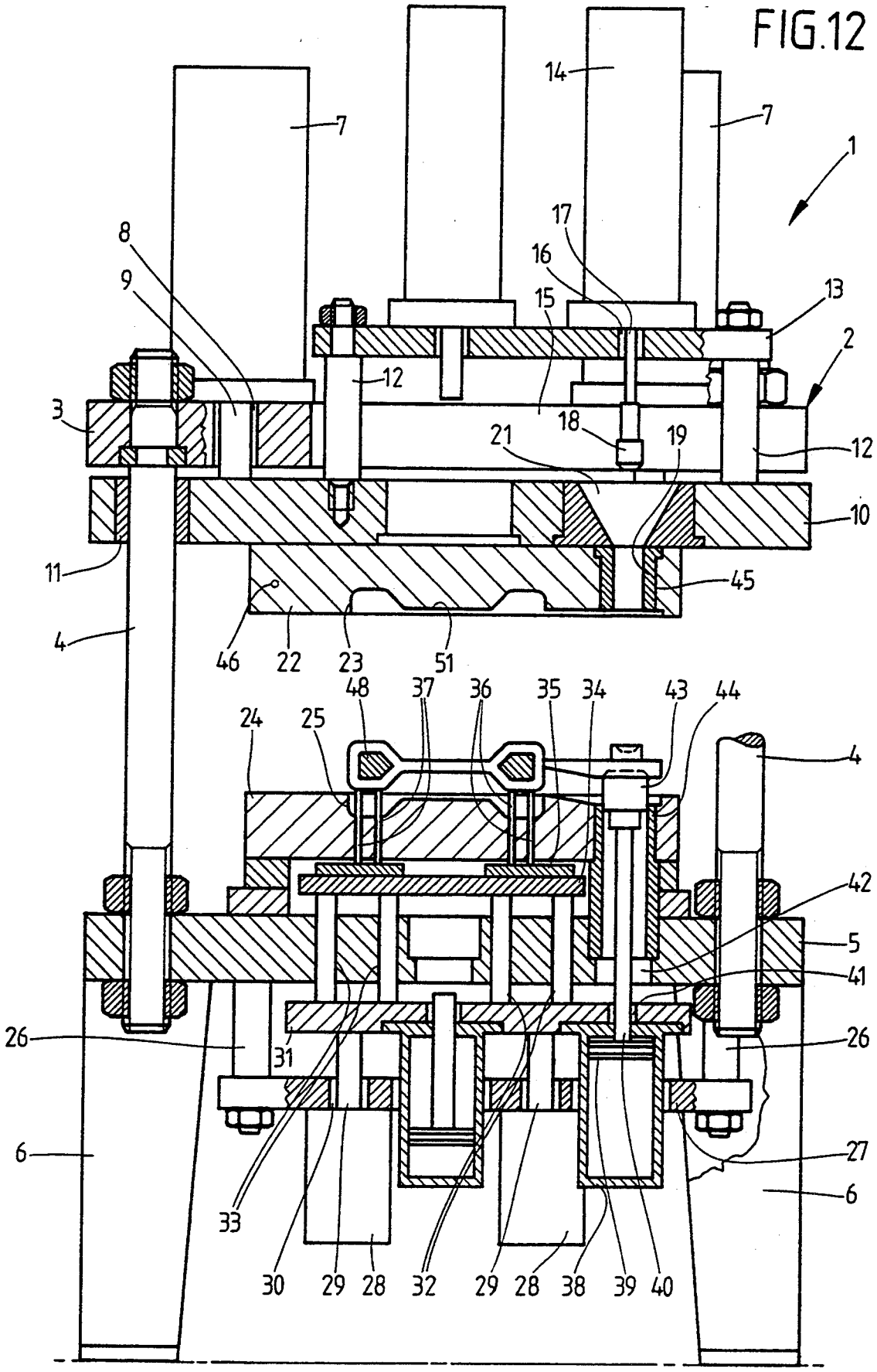
Figure 13:
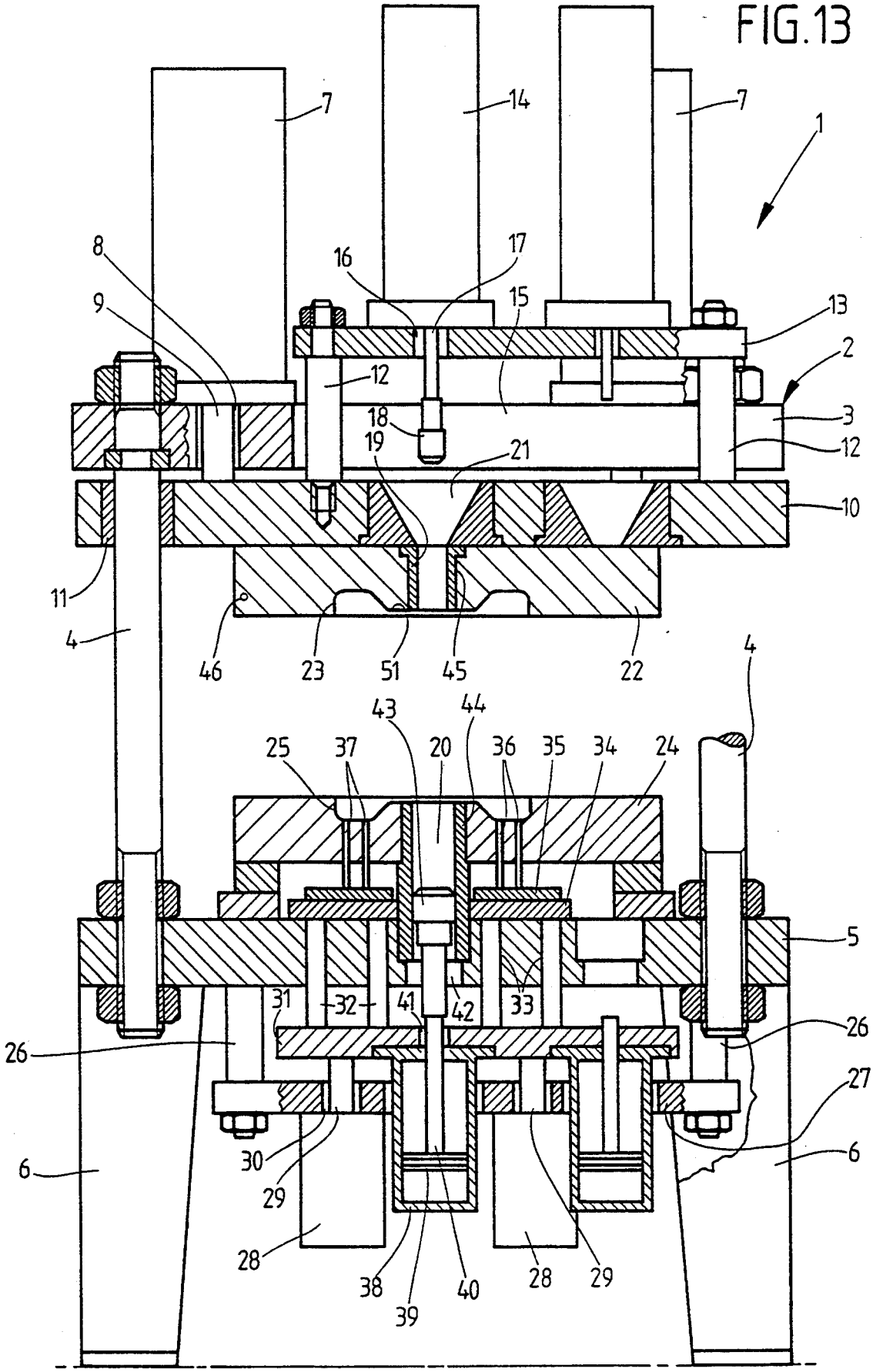
Figure 14:
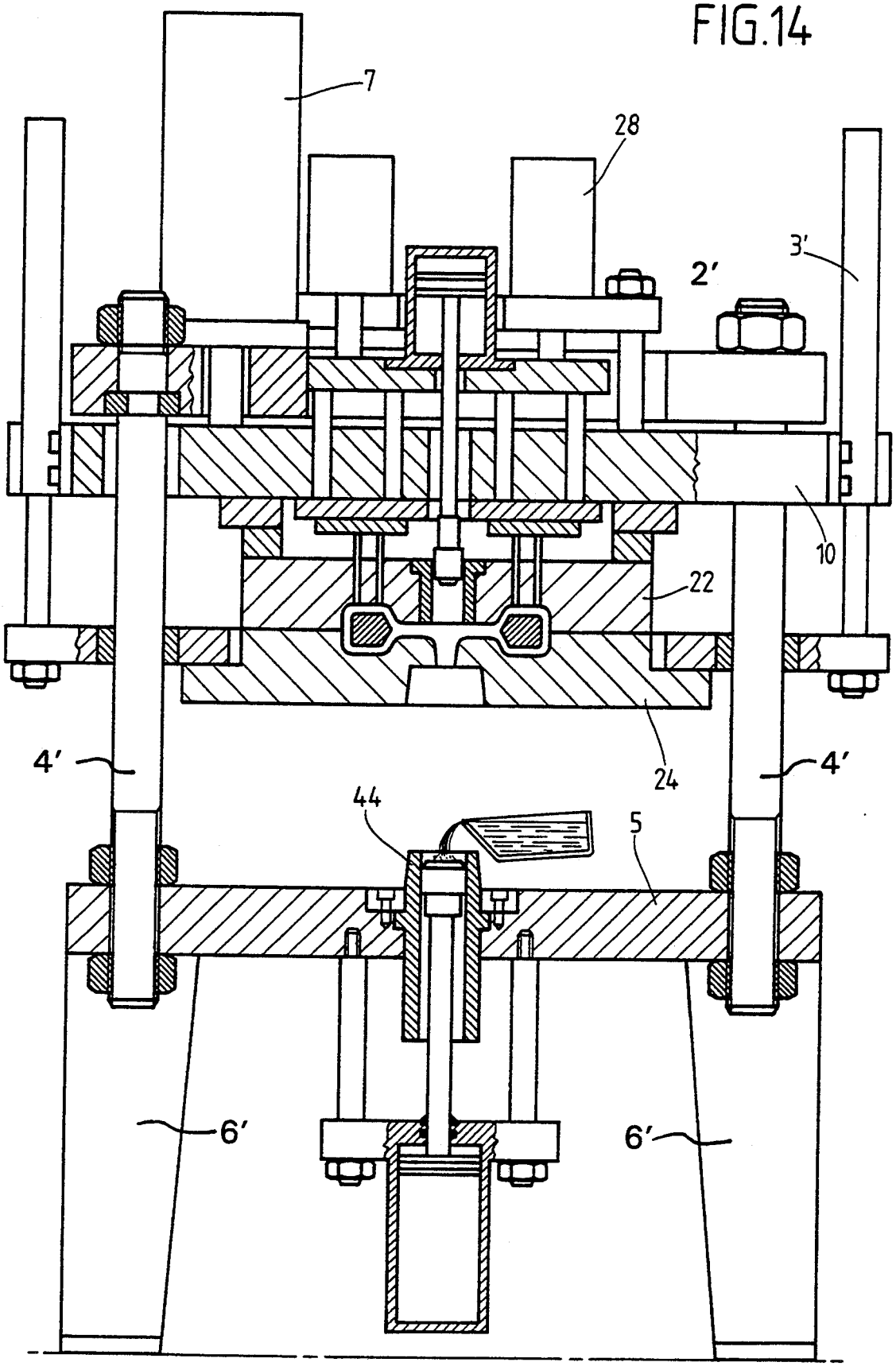

Additional characteristics and advantages of the invention are set forth in the following description, reference being made to the accompanying drawings, which partly schematically show three non-limiting embodiments of a device for press casting according to the present invention. The drawing show in detail in:

FIG. 1 the device according to the invention in its casting position, i.e. subsequent to the closing of the molds and the pouring in of liquid metal but before the actual casting;

FIG. 2 the device according to FIG. 1 subsequent to the lowering of the upper piston into its holding position;

FIG. 3 the device according to FIGS. 1 and 2 subsequent to the movement of the lower piston and the filling of the mold with the upper piston displaced upwards carried out;

FIG. 4 the device according to FIGS. 1–3 in connection with a movement of the upper piston subsequent to the afterfeeding carried out;

FIG. 5 the device according to FIGS. 1–4, the mold being open and the upper piston being moved downwards completely and the product being ready to be ejected;

FIG. 6 the device according to FIGS. 1–5 subsequent to an ejection/release of the molded product and a pulling inwards of the upper piston to the starting position for a new casting cycle;

FIGS. 7–12 a modified device according to the invention, the injection system being displaced from the central area but for the rest corresponding to the device according to FIGS. 1–6; and FIG. 13 a third embodiment according to the invention including an selectable system placed in the central area, and FIG. 14 a fourth embodiment according to the invention with a mainly modified feeding and pouring in of the liquid metal.

In the drawings a device according to the present invention in its entirety is designated 1. This device comprises a machine frame 2, which mainly comprises an upper base plate 3, from which machine bearers 4, e.g. four, project downwards, the lower ends of which support a lower machine table 5, which rests on feet 6.

Upper base plate 3 supports hydraulically form cylinders 7, e.g. four, which are designed to open up and close a casting mold, which will be described below, by means of an already known control system (not shown).

From form cylinders 7 piston rods 9 project downwards through bores 8 in the base plate. An upper machine table 10 is suspended at the lower ends of said piston rods 9 and is displaceable along machine bearers 4 by means of guide bushings 11.

Preferably in a central position on top of upper machine table 10 a yoke 13 is disposed, at a distance from this machine table by means of spacing rods 12, and this yoke 13 supports a cylinder 14 for an upper piston, which cylinder projects upwards through an opening 15 in the base plate, which opening is wide enough to also allow the passage of the yoke therethrough, in a position according to FIG. 3.

Through an opening 16 in yoke 13 a piston rod 17 with an upper piston 18 projects downwards, which upper piston can be introduced into a filling funnel 21, mounted in upper machine table 10, which funnel leads to a feeding and guiding sleeve 19 in the upper mold part. Said sleeve leads in its turn to a filling chamber 20 designed to fill a certain adjusted or predetermined amount of a liquid metal. Said filling chamber is mounted in the lower mold part och extends a small distance below this mold part, preferably having an enlarged diameter in order to allow a position fixation between the lower mold part and the lower machine table.

On the lower side of the upper machine table an upper mold part 22 is fastened, the lower side of which is provided with an upper mold cavity 23.

On machine table 5 a lower mold part 24 rests, the upper side of which in an analogous way is provided with a lower mold cavity 25.

Below machine table 5 a holder plate 27 is mounted by means of spacing rods 26, at a distance from the machine table, the holder plate 27 being designed to hold ejection cylinders 28 mounted below it. Corresponding piston rods 29 extend upwards through openings 30 in holder plate 27 and are designed to in unison support a bridge 31, which is displaceably mounted between machine table 5 and holder plate 27. Bridge 31 supports in its turn e.g. 2–12 ejection rods 32, which extend upwards through holes 33 in machine table 5 and are designed to, above this machine table, support a common connection plate 34 with upper ejection plates 35, ejection pins 37 projecting from these ejection plates into said lower mold part 24 in guiding holes 36 in this mold part, by means of which ejection pins 37 the casting, subsequent to its completed molding, can be ejected, when the mold has been opened up.

In the middle of and below bridge 31 a cylinder 38 of a lower piston is mounted, in which cylinder 38 a piston 39 is disposed, from which a piston rod 40 extends, which extends through openings 41 and 42 respectively in bridge 31 and machine table 5 respectively in order to, with its free end, support a lower piston 43. Sleeve 19 and bushing 45 may also be designed as one unit. Also, the bushings can be cooled directly or indirectly in a way known per se, not shown in detail in this connection. However, cooling conduits are collectively designed by the reference numerals 46 in FIG. 1.

Lower piston 43 and piston rod 40 suitably are cooled too, in which case from piston 39 a connection for a cooling equipment, not shown, may extend downwards through cylinder 38.

The device now described can be used in the following way: FIG. 1 shows, as was mentioned above, this device in its molding position, the molds being closed e.g. around an encased mold insert 48 to define a mold cavity 51. A certain adjusted amount of liquid metal, preferably belonging to the group of non-iron-alloys, has already been filled in chamber 20 and is designated 49. The surface of the filled-in metal suitably will reach a level which is slightly below the lower edge of the molding system.

In order to obtain this precise adjustment one not only start with a predetermined amount of metal but above all from the level of the lower piston, which according to the invention is adjusted to a desired elevational position, which actually allows an exact computable filling of metal, designed to carry out the casting in an optimal way and with the least possible excess amount. The position of the lower piston is adjusted and indicated in a suitable way, e.g. by means of a programmable display panel in an electronic fashion. As appears from the figure, the lower piston has a larger diameter, e.g. between 10 and 300%, than the upper piston, which means that small piston movements result in larger volume changes. The ratio between the diameters of the lower piston and the length of the filling chamber ought to be between 1:1 and 1:4, preferably about 1:2.5. Another important advantage of a lower piston and then also a filling chamber with a larger diameter than the coaxially disposed upper piston and feeding and guiding sleeve respectively is that the downwardly running liquid metal is not allowed to splash into the molding system and be solidified in it prematurely. An additional advantage, thanks to these characteristics of the invention is that the inner wall of the filling chamber, which is provided with a lubricant, will not be sprayed with running metal, which otherwise would result in an uneven distribution of the lubricant and risks of biting and other drawbacks as a consequence. Now the filling chamber wall will instead be-exposed to the liquid metal in a quieter way, which rises successively in the chamber, an even distribution of the lubricant being secured.

In addition to a liquid metal filling through a funnel and a sleeve into the filling chamber, it is also possible to feed the liquid metal in a lateral direction through a tube or a conduit or channel from a storage container.

Subsequently the upper piston will be lowered according to FIG. 2 into a predetermined or programmed holding position, preferably roughly in the middle of sleeve 19. This position is designed to allow a displacement, when a pressure is exerted, to a higher level and a displacement subsequent to the metal feeding to an even higher level. In a practical embodiment the upper piston is designed to, in said normal holding position, resist upwardly directed metal pressures of e.g. 1–20 bars without a position alteration.

According to FIG. 3 the liquid metal has been fed into the molding system by the lower piston, which thanks to its comparatively large diameter exerts an adequate or limited compression pressure, through which the mold in a relatively quiet way is filled with metal, at the same time as, thanks to the more compact design, a considerable amount of centrally stored heat is retained and transmitted to the center of the molding system. The movement of the lower piston is preferably adjustable as regards the speed in the various sections, and it is suitably programmed. In the final phase of the upward movement of the lower piston the upper piston is influenced by a metal column, formed below it, its pressure finally exceeding the adjusted holding pressure and from then on resulting in a limited lifting of the upper piston to an upper holding position. All the time the upper piston continues acting with an adjusted pressure on the metal column. The lower piston finally stops in an upper end position, preferably against a stationary stop element.

In the functional positions between FIGS. 3 and 4 the upper piston has been activated, possibly with a time delay, to move further downwards, exercising an afterfeeding movement, which preferably is adjustable and programmable. During this movement the upper piston, which has a smaller diameter, acts on the central, superheated area above the lower piston and influences there the central metal portion, which is somewhat more mobile and substantially easier than the outer metal portion can be compressed, said central metal portion being compressed from within. Additional heat is thereby evolved, which enhances the flow characteristics of the metal and its workability. Thanks to the smaller diameter of the upper piston the afterfeeding can be done efficiently, the porosity being lowered to a minimum, because the porosity mainly is developed in the central thick-walled portions, which according to the description above are influenced primarily. Finally, the upper piston will stop in its lower holding position according to FIG. 4.

During the transition from the functional position according to FIG. 4 to the position shown in FIG. 5 the upper piston continues first of all to exercise a high compression pressure against the metal column and consequently increasingly projects out of the lifting upper mold part, until e.g. a stationary stop position according to FIG. 5 has been reached, and simultaneously the upper mold part continues its movement upwards to the starting position shown in FIG. 5. When the metal has been solidified in the mold, after e.g. 2–20 seconds, form cylinders 7 are activated and in this way piston rods 9 will pull upper machine table 10 upwards with upper mold part 22, and the upper side of the casting will be free. In order to entirely eject the pressed piece 50 from filling chamber 20 cylinder 14 of the upper piston remains activated and consequently it pushes the piston rod outwards successively, when machine table 10 is moved upwards, the upper piston continuously being pressed against the pressed piece, until the upper machine table has reached its upper starting position according to FIG. 3, in which the cylinder of the upper piston is activated in order to pull the piston inwards to the position shown in FIG. 3. Of course, piston rod 17 can be pulled inwards somewhat earlier, e.g. as soon as a relative position has been reached, in which the pressed piece has left the filling chamber.

Cylinders 28 are activated now, which results in a lifting of bridge 31 and finally in an activation of ejection pins 37, the casting being freed completely also from the lower mold part. The lower piston contributes to this also, since its cylinder is fastened to the bridge, resulting in a movement of also the lower piston besides the ejection pins in relation to the lower mold part. When cylinders 28 have returned to their starting position according to FIG. 1, cylinder 38 will be activated, its piston 39 lifting the lower piston to the position shown in FIG. 3, which is the same position as the position shown in FIG. 2, and in this way a new molding cycle can be initiated.

The free end surface of the lower piston and preferably also its mantle surface are according to a preferred embodiment of the invention provided with a ceramic coating in order to prevent a wear and/or obtain a limited heat insulation. The wall of the filling chamber can also be made of a ceramic material. In this way the metal will be cooled to a minimal extent in the filling chamber, which is desirable, and at the same time the thermal expansion of sleeve 19 and the lower piston respectively will also be relatively limited, which is desirable to preserve the basic tolerances. Also, the upper piston can be cooled in order to achieve a quicker solidification and its mantle surface can, in order to prevent a wear, be provided with a ceramic coating.

Whereas the transition time from one type of coating to another type is between 3 and 4 hours in a conventional press casting machine, the corresponding transition time of a device or machine according to the invention can be lowered to 10–15 minutes. This shows that substantial time savings and rationalization gains are possible according to the invention.

In accordance with the design shown in FIG. 14 the lower mold part can be moved upwards and downwards by means of four cylinders 3', fastened to the upper, movable machine plate. The ejection device has been moved from the lower machine plate to the upper one. The lower injection cylinder is fastened to the lower machine table by means of a fastening flange.

The advantage of this design is that the metal can be poured in to an as low filling level as possible, a frothing and an oxidation being avoided in this way or these effects at least being thoroughly counteracted. This is particularly true as regards aluminum alloys at elevated temperatures and during a low pressure molding. The definitely lowest filling level, or pouring height is obtained, when the filling is done below the mold, as is depicted in the drawing. This could be done in this embodiment by moving the lifting device for the lower mold part as well as the ejection device.

This embodiment will function in the following way: During the filling of the metal the lower piston is pulled downwards successively, and in this way the metal surface will continuously appear adjacent the upper edge of the cylinder or the filling chamber, formed in this way. Subsequently the casting ladle will be removed and upper machine table 10 moved downwards. Thanks to this movement the mold parts can be united by cylinders 3'. Cylinders 3' as well as the ejection device are fastened to the moveable machine plate. The recess in the middle of mold 24 matches cylinder 44. Lower mold 24 now will rest on lower machine plate 5.

The casting is done in the same way as has been described above. During the mold opening two things are activated simultaneously: a) an opening (cylinder 7) of upper machine plate 6'+4'+2'; b) an activation outwards of cylinders 3' of the lower mold part, i.e. they work to retain lower mold part 24 on machine table 5 and in this way divide the mold into parts 22 and 24. When the mold has been opened up sufficiently, the mold opening process is terminated and cylinders 3' and 7 cease working.

The casting has, thanks to the mold opening and a suitable mold construction, been retained in the upper mold part. A suitable device, designed in a way known per se, is introduced between the mold parts in order to receive the casting, which is ejected by means of cylinders 28. The casting can now be removed by means of said device.

The lower mold part is now moved upwards to close the mold. Cylinders 3' are activated and in this way they will in unison pull the lower mold part towards mold part 22. The machine cycle has been concluded and a new such cycle can be initiated with a filling of liquid metal etc.

I claim:

1. A method of press casting in which a liquid metal (49) in a filling chamber (20) is displaced by a lower piston (43) mounted to a lower machine table (5), under the influence of an upper piston (18) mounted in an upper machine table (10), the tables (5 and 10) support a lower mold part (24) and an upper mold part (22) respectively, said lower piston (43) is adjustable in the filling chamber (20) to cause the liquid metal to reach a desired level below a mold cavity (51) between the mold parts (22, 24) and has a larger diameter than the upper piston, characterized by the steps of:

a) lowering the upper piston, subsequent to pouring of the liquid metal into the filling chamber, to a desired position in a guiding and feeding sleeve (19) in the upper mold part;

b) biasing the upper piston to this desired position;

c) moving the lower piston upwards in the filling chamber to feed the liquid metal into the mold cavity;

d) applying sufficient upward feeding force by way of the lower piston and the liquid metal to the upper piston, once the mold cavity is full of the liquid metal, to move the upper piston upward against the bias;

e) allowing the liquid metal to solidify;

f) lowering the upper piston to a lower position; and g) opening the mold parts to release the casting.

2. A method according to claim 1, characterized by adjusting the lower piston to provide the desired level of liquid metal below the mold cavity.

3. A method according to claim 2, characterized in that the desired position of the upper piston is approximately at the center of the guiding and feeding sleeve in order to allow a displacement due to upward pressure to a higher position and the bias is sufficient to resist upwardly directed pressures of between 1 and 20 bars before upward movement of the upper piston occurs.

4. A method according to claim 3, characterized by providing sufficient bias to ensure a compression pressure of the liquid metal whereby the mold is filled with the liquid metal.

5. A method according to claim 3, characterized by providing sufficient bias to ensure a compression pressure of the liquid metal whereby the mold is filled with the liquid metal.

6. A method of press casting in which a liquid metal (49) in a filling chamber (20) is displaced by a lower piston (43) mounted to a lower machine table (5) to fill a mold cavity (23,25) defined by upper and lower mold parts (22,24), under the influence of an upper piston mounted in an upper machine table, the lower piston (43) being adjustable in the filling chamber (20) to cause the liquid metal to reach a desired level, characterized by the steps of:

a) raising the upper and lower mold parts (22,24) to a raised position above the lower machine table (5) and raising the lower piston (43) to a position adjacent an upper edge of the filling chamber (20);

b) pouring liquid metal into the filling chamber (20) from a filling position below the upper and lower mold parts (22,24) and immediately adjacent the upper edge of the filling chamber (20), while simultaneously lowering the lower piston (43) maintaining an upper surface of the metal in the filling chamber adjacent (20) the upper edge of the filling chamber (20) thereby keeping the pouring height as low as possible until the filling chamber is filled to the desired level with liquid metal.

7. A method according to claim 6, further comprising the steps of:

c) lowering the upper and lower mold parts (22,24) onto the lower machine table (5), subsequent to the pouring of the liquid metal into the filling chamber;

d) lowering the upper piston, subsequent to the pouring of the liquid metal into the filling chamber, to a desired position in a guiding sleeve (19) in the upper mold part;

e) biasing the upper piston to this desired position;

f) moving the lower piston upwards in the filling chamber to feed the liquid metal into the mold cavity;

g) applying sufficient upward feeding force by way of the lower piston and the liquid metal to the upper piston, once the mold cavity is full of the liquid metal, to move the upper piston against the bias;

h) allowing the liquid metal to solidify;

i) lowering the upper piston to a lower position; and j) opening the mold parts to release the casting.

8. A method according to claim 6, characterized in that the desired position of the upper piston is approximately at the center of the guiding sleeve in order to allow a displacement due to upward pressure to a higher position and the bias is sufficient to resist upwardly directed pressures of between 1 and 20 bars before upward movement of the upper piston occurs.

9. A press casting machine comprising:

a stationary base plate (3) supporting an upper machine table (10) by hydraulic cylinders (7) for vertical movement relative to the base plate, the base plate and the upper machine table being supported above a lower machine table;

the upper machine table (10) having an upper mold part (22) rigidly mounted to a lower surface thereof, a lower mold part (24) supported, beneath the upper mold part, by the upper machine table (10) (22) by hydraulic cylinders (3') for vertical movement relative thereto, and an upper piston mounted in the upper machine table (1) that extends down into a guide sleeve (19) in the upper mold part that communicates with a mold cavity defined by the upper and lower mold parts (22,24);

the lower machine table (5) having a filling chamber (20) for receiving a liquid metal (49) and a lower piston (43) mounted to the lower machine table (5) that extends upwards into the filling chamber (5) to fill the mold cavity (23,25) with the liquid metal under the influence of the upper piston (18), the lower piston (43) being adjustable from a first position adjacent an upper edge of the filling chamber (20) to a second position at a desired level below the upper edge of the filling chamber (20) to maintain the lowest pouring height possible during pouring of the liquid metal and to measure the desired amount of liquid metal.

* * * * *